US006003359A

United States Patent [19]

Futamura et al.

[11] Patent Number: 6,003,359

[45] Date of Patent: Dec. 21, 1999

[54] PROGRESSIVE DEEP-DRAWING MACHINE

[75] Inventors: Shoji Futamura; Chikara Murata, both of Kawasak, Japan

[73] Assignee: Institute of Technology Precision Electrical Discharge Works, Japan

[21] Appl. No.: 09/180,218

[22] PCT Filed: Feb. 24, 1998

[86] PCT No.: PCT/JP98/00730

§ 371 Date: Apr. 22, 1999

§ 102(e) Date: Apr. 22, 1999

[87] PCT Pub. No.: WO98/39116

PCT Pub. Date: Sep. 11, 1998

[30] Foreign Application Priority Data

Mar. 4, 1997 [JP] Japan ..... 9-048626

[51] Int. Cl.[6] ..... B21D 22/30; B21D 37/16

[52] U.S. Cl. ..... 72/404; 72/364; 72/348; 72/405.06; 72/342.1

[58] Field of Search ..... 72/404, 342.1, 72/342.94, 348, 349, 364, 405.06; 219/153, 154

[56] References Cited

U.S. PATENT DOCUMENTS

| | | | |
|---|---|---|---|
| 2,539,807 | 1/1951 | Brandes | 72/349 |
| 2,925,847 | 2/1960 | Burns | 72/405.06 |
| 3,193,881 | 7/1965 | Kostur | 72/349 |
| 3,964,412 | 6/1976 | Kitsuda | 72/364 |
| 4,427,396 | 1/1984 | Van Den Berg | 148/134 |
| 4,441,354 | 4/1984 | Bodega | 72/364 |
| 4,863,333 | 9/1989 | Kaminski | 72/405.06 |
| 5,735,163 | 4/1998 | Sato | 72/348 |

FOREIGN PATENT DOCUMENTS

| | | |
|---|---|---|
| 58-122128 | 7/1983 | Japan . |
| 5-104296 | 4/1993 | Japan . |

*Primary Examiner*—Daniel C. Crane
*Attorney, Agent, or Firm*—McGlew & Tuttle, P.C.

[57] ABSTRACT

Index-feed deep drawing apparatus comprising a feeding device for intermittently indexing a long-sized work piece, wound in a hoop, in the longitudinal direction, and a plurality of punch/die sets disposed in the feeding direction of the work piece and adapted to sequentially carry out deep drawing at least on the work piece, in which an annealing device adapted to allow the work piece to pass is provided between the deep drawing punch/die sets so as to subject the work piece to intermediate annealing treatment.

4 Claims, 4 Drawing Sheets

PROGRESSIVE DEEP-DRAWING MACHINE

This application is a 371 PCT/JP98/00730, filed Feb. 24, 1998.

TECHNICAL FIELD

This invention relates to deep drawing apparatus used for deep drawing sheet stock, such as a steel sheet, into cup-shaped or bottomed hollow tubular products, and more particularly to index-feed deep drawing apparatus for sequentially deep drawing a long-sized work piece, wound in a hoop, in the longitudinal direction.

BACKGROUND ART

Deep drawing means are publicly known as means for forming cup-shaped containers, for example, from sheet metal. FIG. 4 is a partially cutaway perspective view of a typical process for forming cup-shaped containers using a press mold. In FIG. 4, numeral 101 refers to a punch formed into a cylindrical shape, for example, and vertically movably fitted to a press ram. Numeral 102 refers to a die formed into a hollow disc shape or a hollow cylindrical shape and fitted to a press table in a coaxial manner with respect to the punch 101. Numeral 103 refers to a blank holding pad formed into a hollow disc shape for pressing and releasing a work piece 104 onto and from a die 102 before and after the actuation of a punch 101.

With the above arrangement, a disc-shaped work piece 104 having an initial diameter, $D_O$, for example, is positioned on the die 102 and forced onto the die 102 with a pushing force, Q, with the blank holding pad 103. As the punch 101 is then forced onto the work piece 104 with a drawing force, P, the work piece 104 is deep drawn into a cup-shaped container having a flange diameter, D. In this way, a metal forming process involving radial drawing of the work piece flange part 104*a* is called deep drawing. Deep drawing is a useful metal forming process for forming products having small wall thicknesses, such as cup-shaped containers, without generating a large amount of cutting chips as generated in machine working.

FIG. 5 is a longitudinal sectional view illustrating examples of products formed with deep drawing; (a) being a bottomed hollow tubular product, (b) a hollow tubular one with a through hole on the bottom, and (c) a hollow tubular one. The cross-sectional shape of the product may be a quadrangular, hexagonal, or other shape, in addition to a circular shape. The cross-sectional shape and dimensions may be varied at different locations in the axial direction.

DISCLOSURE OF INVENTION

As noted above, deep drawing is a useful metal forming process having an advantage that a long-sized product, having a large axial length size compared with the cross-sectional size, can be formed. When forming such a long-sized product with a single drawing process, however, abnormal local stresses tend to occur at various portions of a work piece 104, causing wrinkles and/or cracks. It is therefore a common practice to carry out deep drawing in multiple steps. Carrying out deep drawing in multiple steps, on the other hand, could accumulate work hardening, depending on the type of material used for the work piece 104, leading to failure of predetermined deep drawing. To cope with this, it has been necessary to anneal the work piece 104 in the middle of the deep drawing.

In deep drawing involving multiple steps, multiple pairs of molds are usually needed; it has heretofore been a common practice that work pieces of a rectangular or disc shape blanked in advance in a separate process are individually charged on the mold manually, and the molded products are also discharged from the mold manually. This involves troublesome and dangerous operations, making it difficult to improve working efficiency. For products of a small size, the complexity of forming operations would increase, leading to increased manufacturing cost.

Furthermore, annealing treatment to reduce or eliminate the aforementioned work hardening would have to be carried out in batches, increasing the amount of work-in-process in manufacturing processes. This would result in complicated process control and increased manufacturing cost.

It is therefore an object of this invention to provide index-feed deep drawing apparatus that can solve the aforementioned problems inherent in the prior art, and enables easy processing and highly efficient production.

To achieve the above objective, this invention adopts technical means where a feeding device for intermittently indexing a long-sized work piece, wound in a hoop, in the longitudinal direction, a plurality of punch/die sets disposed along the work-piece feeding direction for sequentially deep drawing at least the work piece, and an annealing device disposed between the punch-die sets in such a manner that the work piece is allowed to pass for intermediate annealing are provided.

BEST MODE FOR CARRYING OUT THE INVENTION

Figure 1:
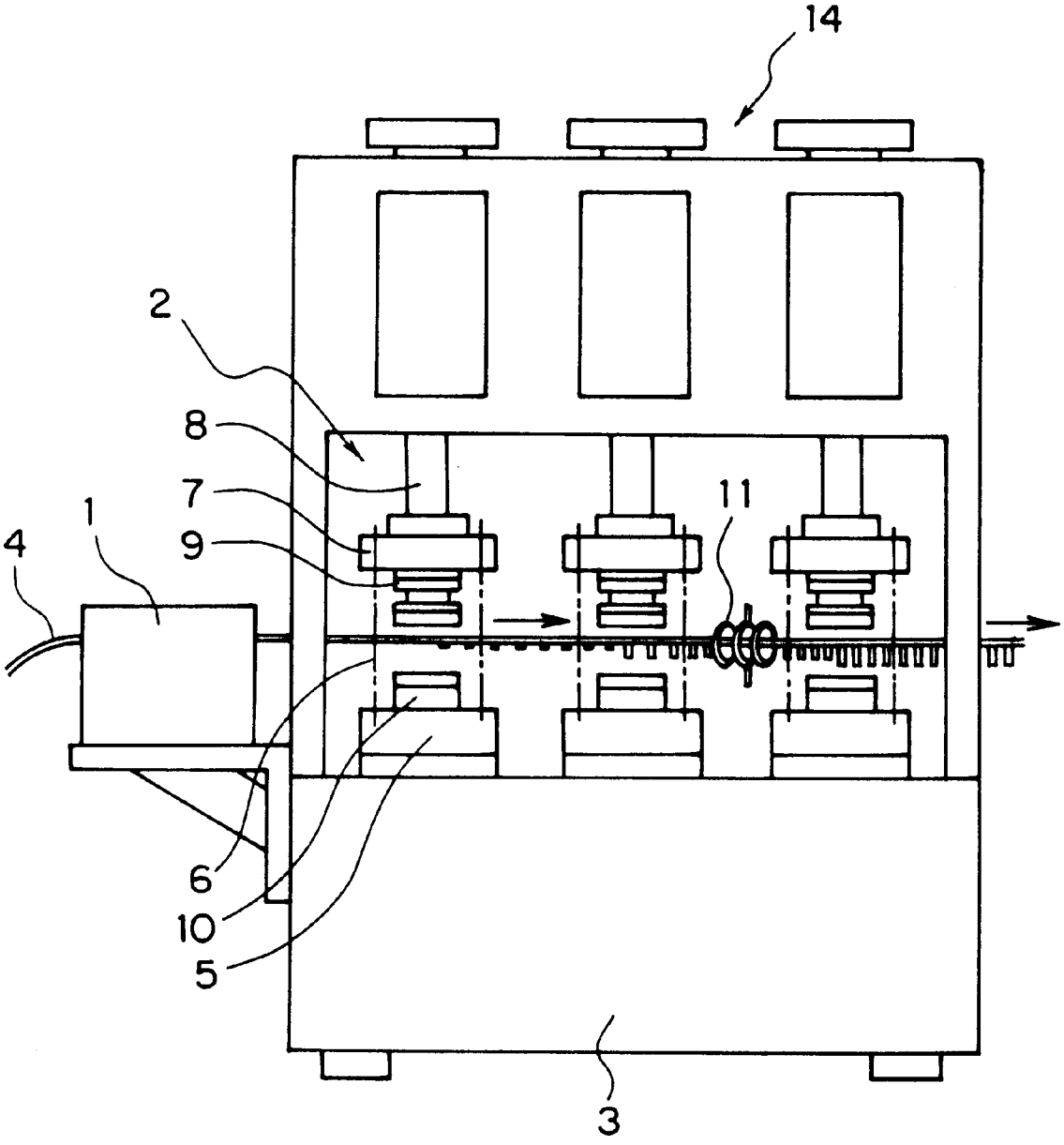
FIGS. 1 and 2 are front and side views, respectively, of an embodiment of this invention.
Figure 2:
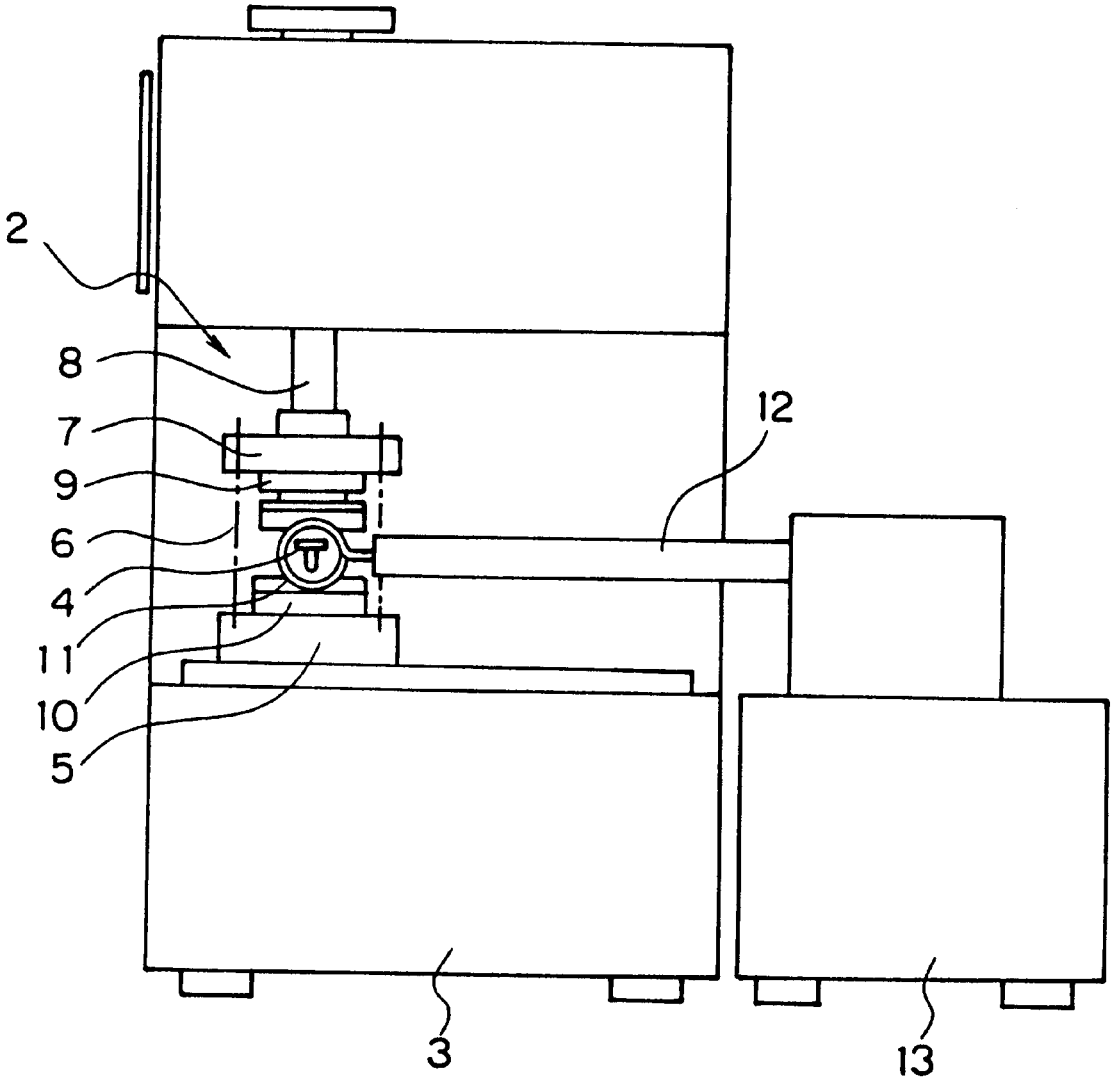

FIGS. 1 and 2 are front and side views, respectively, of an embodiment of this invention. In FIGS. 1 and 2, numeral 1 refers to a feeding device, and 2 to a punch/die set; both provided on a base 3 in the feeding direction of a work piece 4. That is, the feeding device 1 is adapted to intermittently index the long-sized work piece 4, wound in a hoop, in the longitudinal direction, and provided on the most upstream side in the feeding direction of the work piece 4, for example. The feeding device 1, however, may be disposed on the downstream side of the punch/die set 2, or between the punch/die sets 2 and 2.

The punch/die set 2 is such that an upper mold 7 is vertically movably provided via a guide bar 6 provided upright on a lower mold 5; the upper mold 7 being driven by a hydraulic cylinder (not shown), for example, via an actuating lever 8 so that the work piece 4 can be subjected to deep drawing and other forming operations.

On the upper and lower molds 7 and 5 provided are a pair of a punch 9 and a die 10, respectively, for subjecting the work piece 4 to deep drawing and other operations; a plurality of punch/die sets 2 being provided corresponding to required forming operations. The punch/die sets 2 are disposed at intervals of mP (m is a given positive integer, and P is an index feed of the work piece 4) in the feeding direction of the work piece 4, and the positions of the punch/die sets 2 can be adjusted in the feeding direction of the work piece 4 and the direction orthogonal thereto.

Numeral 11 denotes a high-frequency heating coil as a component of the annealing device. The heating coil 11 allows the work piece 4 to pass, and provided between the punch/die sets 2. Numeral 12 denotes a booth bar for supporting the high-frequency heating coil 11 and connecting the coil 11 to a high-frequency power source 13.

Figure 3:
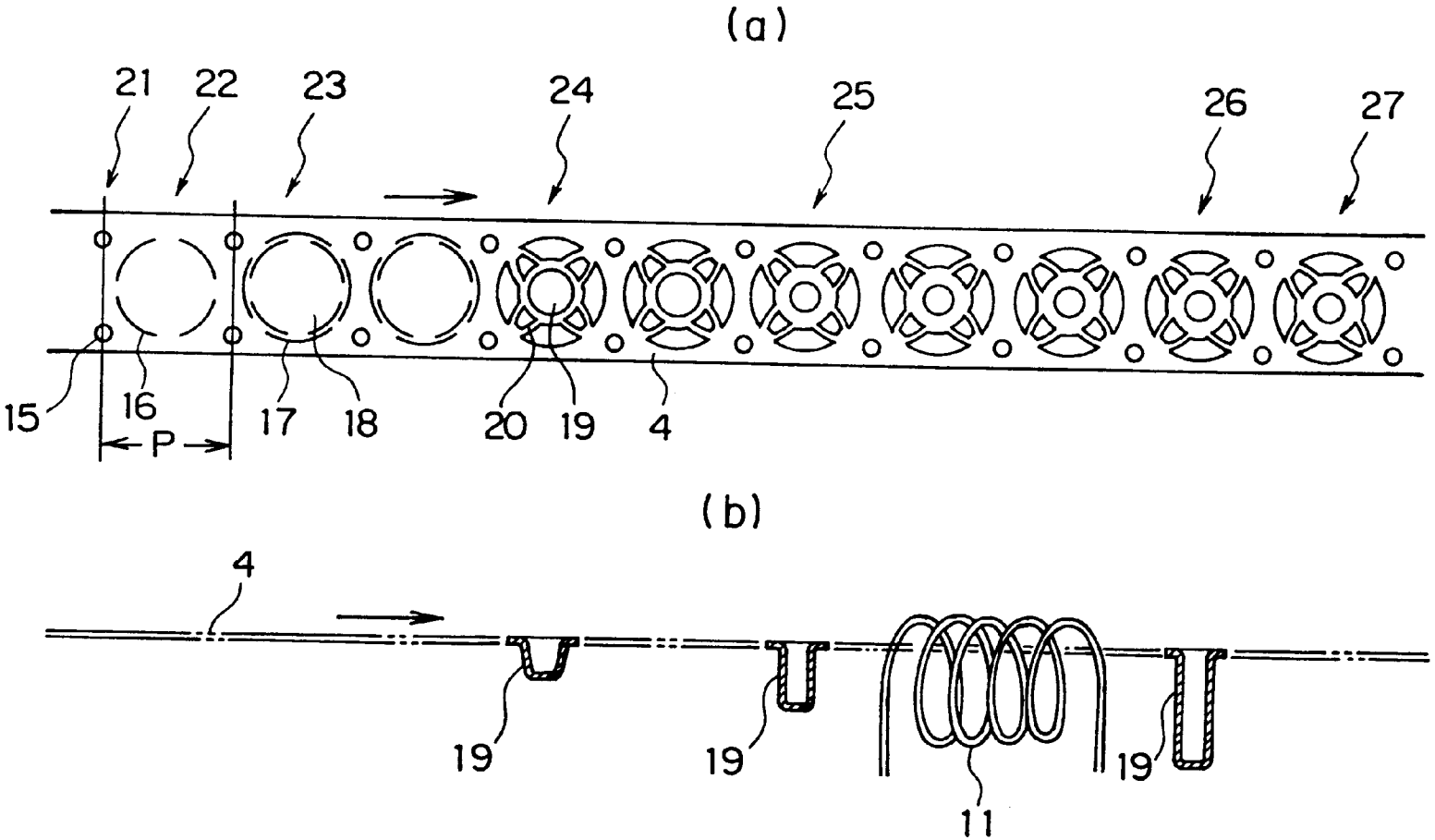
FIG. 3 is a diagram of assistance in explaining the state where a work piece is processed in an embodiment of this invention; (a) being a plan view of a work piece being processed and (b) a longitudinal sectional view of the work piece shown in (a).
Figure 4:
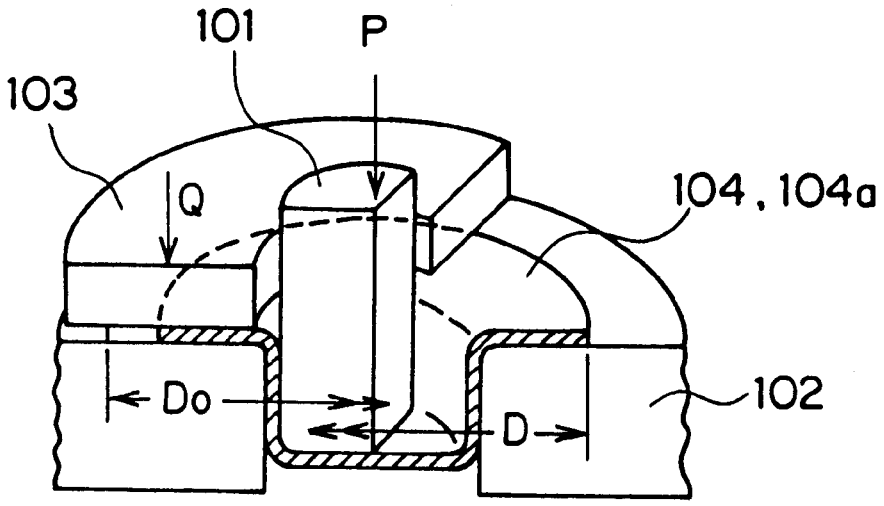
FIG. 4 is a partially cutaway perspective view illustrating an example where a cup-shaped container is formed using a press mold.
Figure 5:
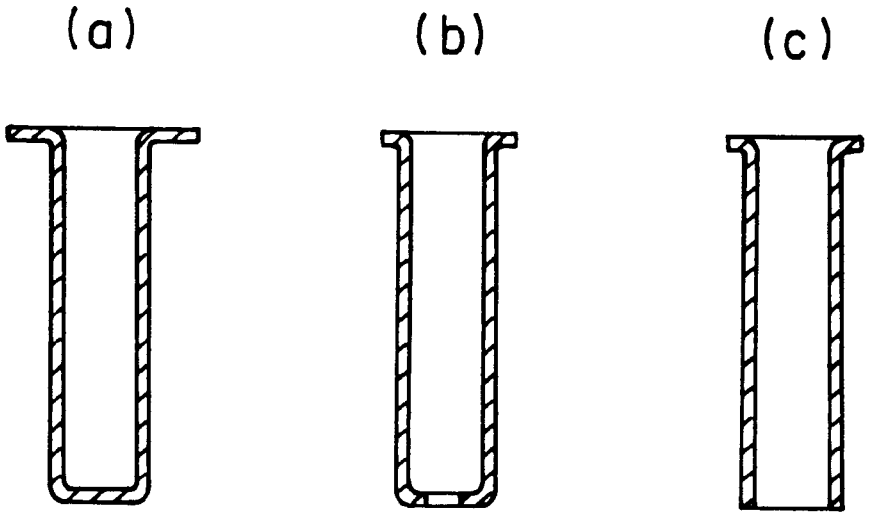
FIG. 5 is a longitudinal sectional view illustrating the shapes of products being formed in deep drawing.

FIG. 3 is a diagram of assistance in explaining the state where the work piece is processed in an embodiment of this invention; (a) being a plan view of the work piece being processed, and (b) a longitudinal view of the work piece shown in (a). In FIG. 3, numerals 21~27 are processing steps, comprising a pilot hole punching step 21, a first slitting step 22, a second slitting step 23, a first drawing step 24, a second drawing step 25, a third drawing step 26 and a punching and separating step 27.

A plurality of the punch/die sets 2 shown in FIGS. 1 and 2 are provided on the base 3 corresponding to the aforementioned processing steps 21~27. When installing this many punch/die sets 2, an adequate number (three units in FIG. 1) of punch/die sets 2 may be installed on a unit 14, as shown in FIG. 1, and an adequate number of units 14 may be connected in tandem in the feeding direction of the work piece 4, instead of disposing them on a single unit of the base 3.

In FIG. 3, the work piece 4 is intermittently indexed at intervals of a predetermined pitch, P, by the feeding device 1 shown in FIG. 1 in the direction of an arrow shown in FIG. 1. Numeral 15 refers to a pilot hole provided in multitude regularly at intervals of a predetermined pitch, P, on the work piece 4 by the punch/die set 2 on the most upstream side shown in FIGS. 1 and 2 in the pilot hole punching step 21. The pilot holes 15 serve as reference holes in positioning the work piece 4 in the subsequent steps.

In the first slitting step 22, pilot pins (not shown) are engaged with the pilot holes 15 to position the work piece 4 in the punch/die set 2 (the same applies to the subsequent steps), and then a circular-arc-shaped slit 16 is provided. In the second slitting step 23, another slit 17 is provided in the same manner to form a pseudo-disc-shaped blank 18 on the work piece 4.

The work piece 4 is further indexed in the direction shown by an arrow, subjected to the first and second deep drawing steps 24 and 25, with an adequate number of idling steps intervening therebetween, to form a cup- or cap-shaped formed piece 19. Numeral 20 refers to a connecting part having a small width to connect the formed piece 19 and the work piece 4.

Upon completion of the first and second deep drawing steps 24 and 25, work hardening takes place on the formed piece 19. Further deep drawing, with work hardened parts left as they are, may cause wrinkles and/or cracks on the formed piece 19.

To reduce or eliminate work hardening, the work piece 4 is passed through a high-frequency heating coil 11 for intermediate annealing treatment.

Since the formed piece 19 connected to the work piece 4 via the connecting parts 20 is softened in this intermediate annealing treatment, further deep drawing can be carried out smoothly in the third deep drawing step 26 to form a formed piece 19 having a predetermined shape and size. That is, the existence of the connecting parts 20 having a small width prevents the heat of the formed piece 19 being deep drawn from being transferred to the work piece 4 having a large heat capacity. As a result, only the formed piece 19 can be heated. The connecting parts 20 are cut off in the final punching and separating step 27 to punch and separate the formed piece 19.

In the embodiment described above, the deep drawing operation is divided into three steps, but it may be divided into an appropriate number of steps, depending on the material type, shape, dimensions, etc. of the work piece 4. The intermediate annealing treatment may be interposed between most suitable processing steps, taking into consideration drawing ratio and other factors in deep drawing.

INDUSTRIAL APPLICABILITY

This invention having the aforementioned construction and operation can accomplish the following beneficial effects.

(1) Since deep drawing can be carried out continuously in an indexing mode, all manual operations for charging and discharging work pieces into and from molds can be completely eliminated. Thus, deep drawn pieces can be produced easily.

(2) Since intermediate annealing treatment can be carried out automatically in the middle of deep drawing operations, with formed pieces connected to the work piece, production can be accomplished with high efficiency.

(3) Even formed pieces having small dimensions may be transferred between different processes in a state where they are connected to a work piece, not as independent and separate pieces. This results in a very small amount of work-in-process, easy transportation and a substantial reduction in manufacturing cost.

We claim:

1. Index-feed deep drawing apparatus comprising a feeding device for intermittently indexing a long-sized work piece, wound in a hoop, in the longitudinal direction, and a plurality of deep drawing punch/die sets disposed in the feeding direction of said work piece and adapted to sequentially carry out deep drawing at least on said work piece, and an annealing device adapted to allow said work piece to pass therethrough is provided between said deep drawing punch/die sets so as to subject said work piece to intermediate annealing treatment.

2. Index-feed deep drawing apparatus as claimed in claim 1 wherein said annealing device is a high-frequency heating coil.

3. Index-feed deep drawing apparatus as claimed in claim 1 wherein said feeding device is provided on the most upstream side in the feeding direction of said work piece.

4. Index-feed deep drawing apparatus as claimed in claim 1 wherein said punch/die sets are arranged so that formed pieces after deep drawing are connected to said work piece via connecting parts having a small width.

* * * * *